United States Patent [19]

Neville et al.

[11] Patent Number: 5,058,793

[45] Date of Patent: Oct. 22, 1991

[54] APPARATUS FOR GUIDING A MOVING STRIP

[75] Inventors: Harvey E. Neville, Shaker Hts.; Chih P. Hung, Strongsville, both of Ohio

[73] Assignee: The North American Manufacturing Company, Cleveland, Ohio

[21] Appl. No.: 465,373

[22] Filed: Jan. 16, 1990

[51] Int. Cl.[5] ..... B65H 23/02

[52] U.S. Cl. ..... 226/15

[58] Field of Search ..... 226/15, 16, 18, 19, 226/3, 20; 242/57.1

[56] References Cited

U.S. PATENT DOCUMENTS

| | | | |
|---|---|---|---|
| 3,268,140 | 8/1966 | Rouyer | 226/18 |
| 3,313,461 | 4/1967 | Andersen | 226/20 |
| 3,568,904 | 3/1971 | Kurz | 226/15 |
| 4,470,555 | 9/1984 | Lawson | 226/19 X |
| 4,485,982 | 12/1984 | St. John et al. | 226/15 X |
| 4,557,372 | 12/1985 | Rajagopol | 242/57.1 X |
| 4,648,539 | 3/1987 | Dingerkus | 226/19 |
| 4,860,964 | 8/1989 | Ishii et al. | 226/19 X |

*Primary Examiner*—Daniel P. Stodola
*Assistant Examiner*—Paul Bowen
*Attorney, Agent, or Firm*—Body, Vickers & Daniels

[57] ABSTRACT

Apparatus for guiding a strip traveling along a selected path, which apparatus comprises a primary strip position correcting mechanism, such as a payout reel or steering roll that engages a strip at a first location for changing the position of the strip as the strip moves along from the first position to a remote control point. The strip correcting mechanism includes a primary control loop with an actuator for changing the strip position and a feedback control loop that compares the actual strip position with an adjustable reference value to control the position of the moving strip. An edge sensor at the remote control point on the strip path creates an output error signal generally proportional to the deviation of the strip edge at the remote control point from a preselected edge position. This error signal is used for periodically changing the reference value of the position correcting mechanism in the primary loop in accordance with the output error. The apparatus employs the concept of creating a series of counting bursts each having a count pulse, the number of which is determined by a given frequency component and a selected duration component. At least one of these components defining the count pulses of each counting bursts is varied in accordance with the magnitude of the output error signal so the reference value of the primary loop is changed by the output error signal.

6 Claims, 7 Drawing Sheets

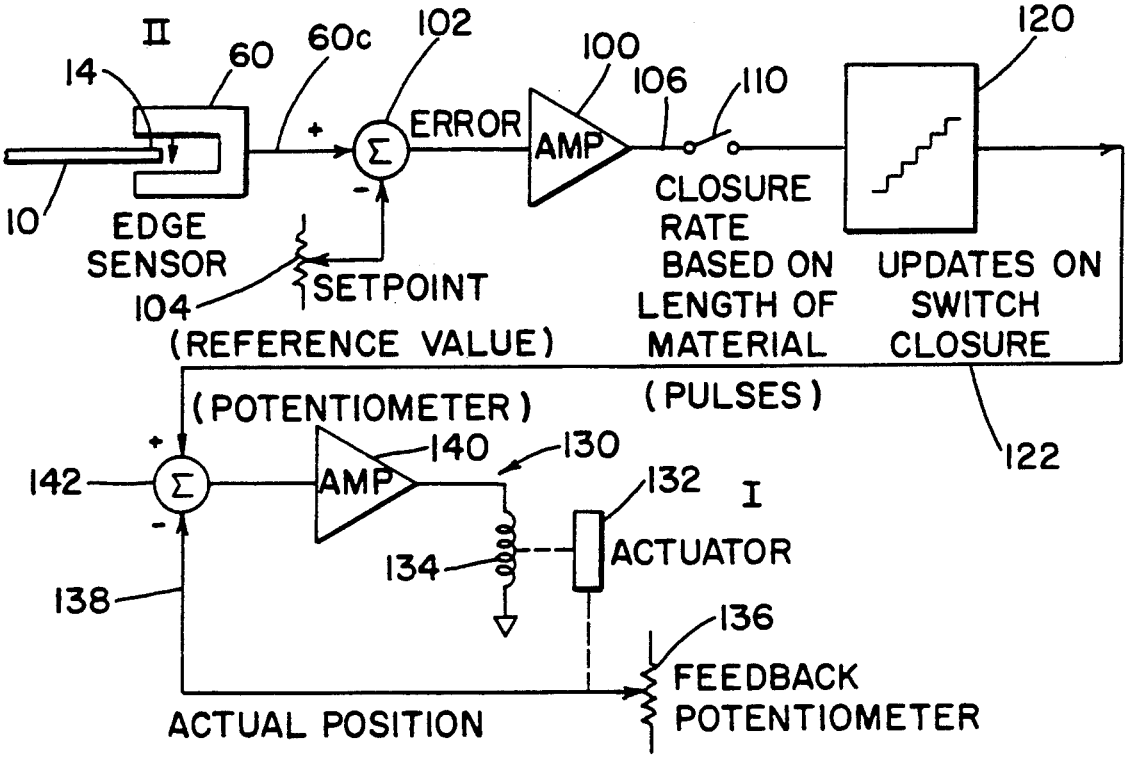
FIG. 2
(PRIOR ART)
FIG. 4
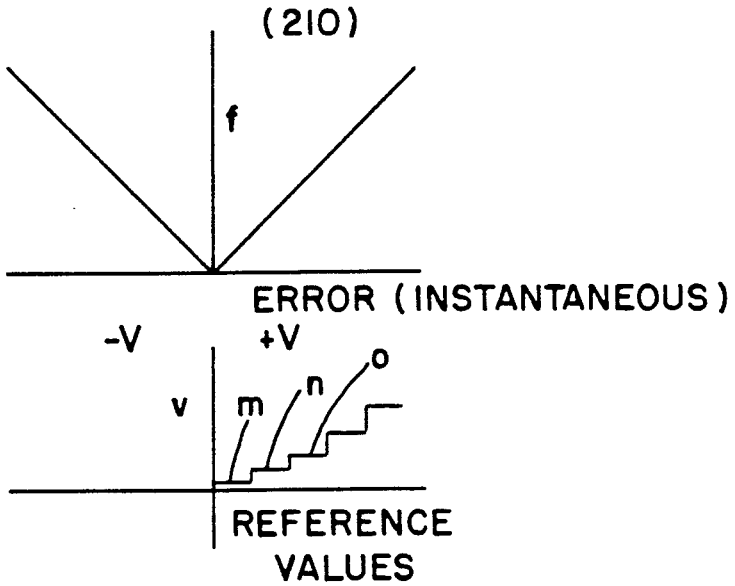
FIG. 4A

APPARATUS FOR GUIDING A MOVING STRIP

The present invention relates to the art of controlling the lateral position of a moving strip and more particularly to a method and apparatus for guiding a moving strip.

INCORPORATION BY REFERENCE

U.S. Pat. No. 3,568,904 is incorporated by reference herein as disclosing both a single control loop and a dual control loop sample data strip guiding system wherein an output signal from a remotely positioned edge detector is used to control the direction and amount of corrective action at the payout position of the strip. A periodic error sample is taken when a pulse generator determines movement of a given length of strip from the payout roll to the remote control point. In accordance with the single loop concept, the actuator for changing the position of the strip is controlled directly by the periodic error sample. In the dual loop concept, the set or offset point of a second sensor or edge detector adjacent the strip payout reel is adjusted by the periodic error sample so that a primary loop servomechanism, including the actuator is modified by the periodic error sample. This is done by changing the set point of the closely spaced edge detectors or by moving the edge detectors with respect to the strip on the basis of a remotely created error sample. The dual loop concept can include a primary feedback loop where the remote secondary loop adjusts the set point of the primary loop. This patent is incorporated by reference herein as background information and as illustrating types of control systems in which the present invention can be employed. The technology disclosed in this prior patent need not be repeated herein to understand the present invention.

U.S. Pat. No. 4,648,539 illustrates a strip guiding system employing remotely located edge detectors that create an error signal which is the difference between the actual position of the moving strip and the desired position of the moving strip at a remote location. This error signal is then multiplied by a continuous speed signal and is integrated for stability to adjust the set point of a primary control loop of the servo-mechanical type. This prior system is a continuous system as distinguished from the sampling system employed in the above mentioned patent and as used in the present invention. This second patent is incorporated by reference herein to illustrate a remote edge detector that can control the set point of a primary, feedback loop mechanical system employing an actuator which is adjusted in accordance with the actual position of the actuator as compared with a set point. Technology contained in this second patent need not be repeated for an understanding of the present invention. This prior patent forms further background information regarding the technology to which the present invention is directed.

The present invention relates to the concept of controlling the lateral position of a moving strip at a remote location substantially spaced from a payout reel or a steering roll by adjusting the position of the payout reel or a steering roll by a mechanical actuator based upon the positional error detected at the remote position; however, the invention has application to various types of strip guiding systems, such as a system wherein the offset of edge detectors close to the payout reel is adjusted by the error sensed at a remote position or the set point of an edge detector or a primary control loop adjacent the reel or steering roll is adjusted by the error detected at the remote position. These various types of systems will be described and can employ the inventive concepts of the present invention. The invention can be used to adjust a payout reel and will be discussed with respect to this type system; however, the invention has broader applications and can be used to adjust a steering roll or other strip positioning devices.

Strip guiding systems generally employ a sensor adjacent the payout reel which determines the position of the strip as it moves from the payout reel. As the sensor detects deviation from a desired position, a signal is created that shifts an actuator on the payout reel to adjust for the detected error. If these sensors are located closely adjacent the payout reel the adjustment may not control the strip alignment at a remote location where such alignment is required. Thus, in accordance with somewhat standard practice, edge detectors are often placed at a remote control point where the edge of the strip is to be accurately positioned. Since the control point is substantially remote from the actuator used to control the position of the strip, control stability is quite difficult. To increase the stability, the remote detector has, in the past, been periodically interrogated to determine the amount and direction of any error between the actual strip position and the desired strip position at the control point. This error is used to create an error signal or sample to adjust the primary correcting mechanism at the payout reel. If the primary adjusting mechanism at the reel is a closely positioned edge detector which creates its own error signal through comparison with a set point, the remotely created error signal or sample is employed for adjusting the set point of the primary correcting mechanism, known as the conventional primary control loop.

Prior systems of the type explained above have used a data sample system wherein the magnitude of the error detected at the remote control point is periodically used to update an analog signal which forms a reference value that is employed at the primary conventional control loop to change the offset or set point of the primary loop. This update is accomplished periodically at a rate determined by the time during which a particular length of strip passes the control point. This time is usually adjusted to correspond with the distance of the remote edge detectors or sensors from the primary conventional control loop employed for correcting the position of the moving strip.

In the past, these systems using a remote edge detector to adjust the conventional primary control loop have been somewhat slow in response and have involved a certain amount of hunting and a lack of system stability. In addition, when a substantial edge deviation is detected at the remote control point, correction at the primary loop sometimes requires a substantial amount of time due to the inherent circuit limitations heretofore employed. For instance, the rate of correction is independent of the magnitude of the error in the system of U.S. Pat. No. 3,568,904; consequently, large errors require substantial correction time. Also, prior mechanical systems have less accurate system response than digital systems.

THE PRESENT INVENTION

The disadvantages of prior systems which employ a remote edge detector for adjusting the set point or offset of the conventional primary control loop in a strip guiding system are overcome by the present invention which relates to an improvement in the processing of the remotely detected error so that a more accurate adjustment is made at the conventional primary control loop. In accordance with the present invention, there is provided an apparatus for guiding a strip traveling along a selected path. This apparatus comprises a strip position correcting means engaged with the strip at a first location for changing the position of the strip as it moves from this first position along the path. This strip correcting means, which is sometimes referred to as the conventional control loop, includes an actuator for moving the strip position and a feedback control device that creates an actual position indicating signal, which may be a mechanical signal or an error signal from a closely positioned edge detector, and an adjustable reference value. The feedback control device adjusts the actual position indicating signal toward the reference value. In this type of system, an edge sensor or detector is located at a control point on the strip path which is remote to the actuator. This edge sensor, or detector, has an output error signal generally proportional to the deviation of the edge of the strip from a selected position at the remote control point. A control device is provided for periodically changing the reference value of the primary control loop in accordance with the remote output error signal. This control device is a gate that creates a series of counting bursts, each burst having a number of count pulses. The number of count pulses in a burst is dictated by a frequency component and a duration component. The frequency or duration component is varied in the counting bursts in accordance with the magnitude of the output error signal from the remote detector or sensor. Then a counting means, such as a digital up/down counter, is employed for accumulating the counting pulses in the series of counting bursts.

In accordance with the invention, the guiding system of the type used before and shown in U.S. Pat. No. 3,568,904 is modified so that individual counting bursts are periodically directed to a counter at a rate determined by the time required for a given length of the moving strip to pass the control point. As the speed of the strip increases, the time necessary for a given length of strip to move along the path is decreased. As the speed of the strip decreases, the time for the given length of strip to pass the control point increases. The sample time is, thus varied according to the time necessary for a given length of strip to pass a given point. These counting bursts are the output of a voltage controlled oscillator having a frequency controlled by the detected error in a manner wherein the frequency increases as the detected error increases. The duration of the counting bursts used in the present invention is determined by a one shot device having, in one embodiment, an output pulse of a fixed duration. This fixed pulse is created whenever a given length of strip moves along the strip path. Consequently, the number of counting pulses in a given counting burst, in the first embodiment, is controlled by the frequency of the voltage controlled oscillator. As the error increases, the frequency increases. If this increase is linear, the number of counting pulses during a counting burst is indicative of the magnitude of the error. The counting bursts are directed to a digital counter, which either counts up or down according to the polarity of the error signal. The output of this digital counter is directed to a digital to analog converter which creates an analog signal that is used as the reference value as a set point or offset in the primary control loop of the guiding system.

In accordance with another aspect of the invention, the voltage controlled oscillator has a gain which is changed as the error increases. Thus, the output of the voltage controlled oscillator is not linear. As the error increases, a greater number of counts are created during a pulse from the one shot device. As the error increases a greater effect is created on the counting device and on the voltage level constituting the output reference value. To further increase the impact of higher detected errors at the remote location, the one shot device is provided with a pulse width modulator that is controlled by the magnitude of the error at the remote location or control point. As the error increases, the duration of the one shot pulse automatically increases. Consequently, the width of the counting bursts progressively enlarges as the error increases. In this manner, even with a linear output for the voltage controlled oscillator, a greater number of count pulses are directed to the accumulator or counter as the remotely detected error increases.

The primary object of the present invention is to provide an apparatus and method for guiding a moving strip having a conventional primary control loop at a payout reel or steering roll and employing a remote edge detector or sensor, which method and apparatus more accurately processes the error signal for control of the set point and/or offset of the conventional primary control loop adjacent the reel or roll.

Yet another object of the invention is the provision of an apparatus and method, as defined above, which apparatus and method can be employed in existing camber control or centering guide systems for moving strip somewhat inexpensively and by mere retrofitting.

Still a further object of the present invention is the provision of an apparatus and method, as defined above, which apparatus and method periodically samples the error at a remote position and converts this sample into a plurality of groups of counting pulses, referred to as counting bursts, where the number of pulses in the bursts controls the magnitude of the requested correcting function during each sample or burst.

These and other objects and advantages will become apparent from the following description taken together with the accompanying drawings.

BRIEF DESCRIPTION OF DRAWINGS

FIG. 2 is a schematic block diagram of a prior art strip guiding system employing a remotely located edge detector and a mechanical servo-mechanism with mechanical feedback;

FIG. 4 is a function curve for a voltage controlled oscillator having a linear output for use in the present invention;

FIG. 4A is a graph illustrating, schematically, aspects of the correction function accomplished by a voltage controlled oscillator having the function curve of FIG. 4;

PREFERRED EMBODIMENTS OF THE INVENTION

Figure 1:
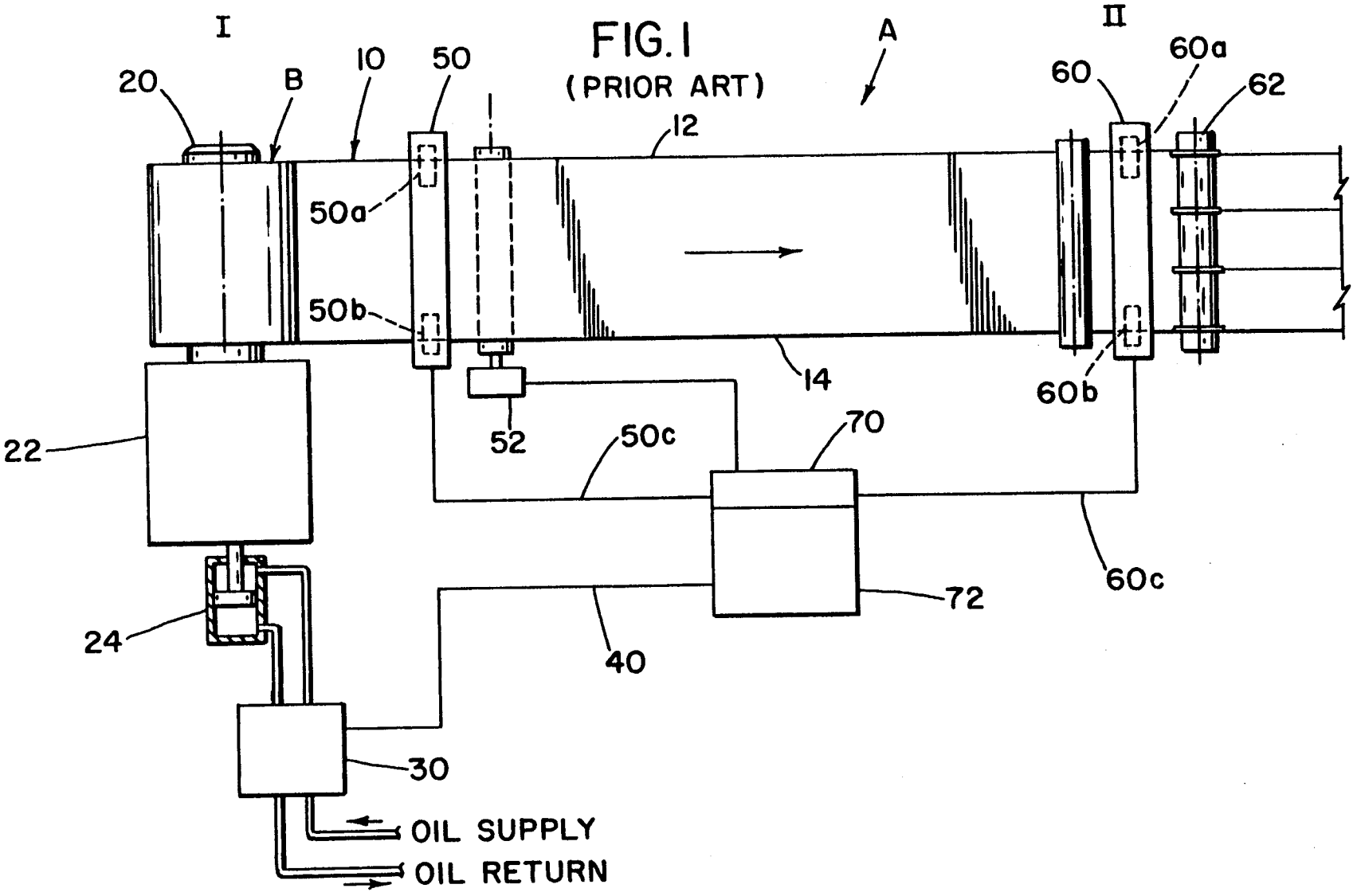
FIG. 1 (PRIOR ART)
FIG. 1. is a schematic diagram of a prior art strip centering system employing two sets of edge detectors.

Referring now to the drawings wherein the showings are for the purpose of illustrating preferred embodiments of the invention and not for the purpose of limiting same, FIG. 1 shows a prior art system A used for guiding a strip wherein the strip 10 must be centered immediately before being slit. In this schematically illustrated prior art system, payout reel B is employed for controlling the position of the moving strip. Two spaced detectors are illustrated, one adjacent the reel at position I and the other adjacent the control point II, at which strip centering is critical. Strip 10 includes spaced edges 12, 14 and is moved along a preselected path between mandrel 20 of payout reel B at position I and position II. Reel B is shifted or adjusted by an actuator 22. In accordance with standard technology, a double acting hydraulic cylinder 24 is operable in two directions to control the payout position of reel B on which a coil of strip 10 is mounted. A control motor 30 receives a command signal in line 40. This command signal indicates deviation of actuator 22 from a desired position as determined by both a close, primary edge detector 50 at position I and a remote secondary edge detector 60 adjacent slitter 62 at control point II. Although a single edge detector could be employed, the illustrated prior art embodiment is for centering of strip 10; therefore, two axially spaced detectors 50*a*, 50*b* and 60*a*, 60*b* are employed. The output of detector 50 is an error signal in line 50*c*. The error of detector 60 is directed through line 60*c* to a sample data circuit 70 which also receives the pulsed output of pulse generator 52. The error signal in line 60*c* is sampled when a preselected amount of strip A moves past the pulse generator 52. This sampled data is periodically used to update set point for the error signal in line 50*c*. The difference between the adjustable set point, updated periodically by line 60*c*, and the detected error in line 50*c* is a signal directed to servo control mechanism 72 to provide a feedback signal in line 40 for adjusting the actual position of actuator 22. This system is a two loop control system employing two spaced center detectors, one located adjacent the actuator 22 (I) and the other adjacent the control point (II). The error at control point II is sampled whenever a certain preselected length of strip passes by pulse generator 52 so that periodic sampling of the detected error can be employed for adjusting the position of actuator 22. The rate of sampling is controlled by strip length. The rate is normally correlated with the spacing of the control point II from the unwinding location I. In this manner, there is an opportunity for the detected error to be used for corrective action at actuator 22. In this prior system, the spaced detectors 50*a*, 50*b* can be adjusted in accordance with the signal in line 60*c* for the purpose of controlling the feedback signal in line 40. FIG. 1 provides background information to assist in understanding the environment to which the present invention is directed. The present invention can be employed in various types of strip guiding devices by controlling offset and/or set point in a conventional primary control loop of a strip guiding system.

As further background information regarding the environment to which the present invention is specifically directed, a second prior art strip guiding mechanism is schematically illustrated in FIG. 2 wherein a single edge 14 of strip 10 is sensed by a single edge detector 60 at control point II. The output of detector 60 in line 60*c* is directed to an error amplifier 100 having the standard summing input junction 102 where one input is the set point determined by potentiometer or set point 104. Error amplifier 100 produces an error signal in line 106. The voltage level on line 106 is indicative of the position of edge 14 as compared to the desired position determined by the adjustable set point 104. A schematically illustrated switch 110, which can be a digital switch, is closed at a rate based upon the length of the strip moving along the preselected path. As previously indicated, pulses from pulse generator 52 determine when a precise length of strip has moved along the path. By counting the pulses from generator 52, a sampling of the voltage level in line 106 can be made whenever a precise length of strip has moved along the control path of movement. Thus, closure of the schematically illustrated switch 110 directs the voltage level on line 106 to a stepping function generator or mechanical position monitor 120 in the form of a motion driven potentiometer. The generator or monitor has an output in line 122 which has a voltage that is increased according to the voltage on line 106 when the voltage on line 106 has a positive polarity. The voltage on line 122 decreases according to the error voltage on line 106 when the voltage on line 106 has a negative polarity. Thus, the analog voltage on line 122 is a reference value indicating the updated status of the strip edge at control point II. The reference value is updated upon each closure of schematically illustrated switch 110.

The voltage level on line 122 is employed as the set point for the conventional primary control loop 130 including a feedback from actuator 132 which is used to control a payout reel or steering roll in accordance with the voltage across position control drive 134. The voltage from amplifier 140 controls the speed and direction of the movement of actuator 132. The actual position of actuator 132 is converted into a voltage by potentiometer 136 and is directed to error amplifier 140 at the input summing junction 142 on input line 138. The other input of the summing junction 142 is reference value 122 at the output of generator or monitor 120. Consequently, the secondary loop controlled by edge detector 60 at control point II controls the primary loop 130. When comparing the dual loop system of FIG. 1 to the dual loop system of FIG. 2, it is noted that in FIG. 2 the primary loop does not involve a closely located second edge detector 50. The present invention can be employed for either type of dual loop system. FIGS. 1 and 2 are provided in the present disclosure for environmental background information; however, the preferred embodiments of the present invention are specifically directed toward the system illustrated in FIG. 2. The invention is a circuit positioned between the error signal voltage line 106 and the reference value line 122. It is irrelevant how the voltage error signal in line 106 is created at remote location II or for what specific purpose the reference value on line 122 is employed in the primary loop of an edge guiding system.

Figure 3:
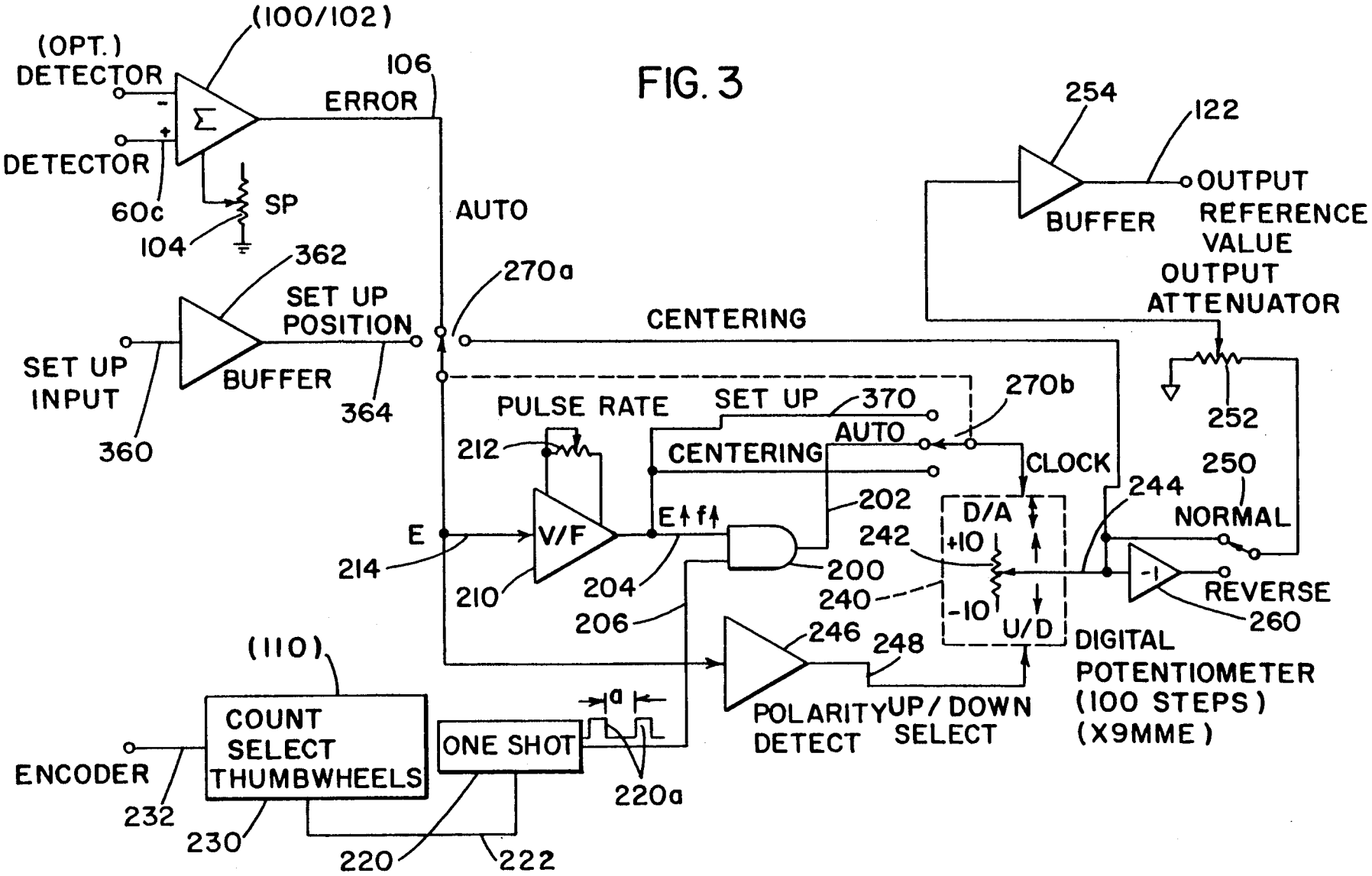
FIG. 3 is a schematic block diagram of the first preferred embodiment of the present invention for use in either of the systems shown in FIG. 1 and FIG. 2.
Figure 5:
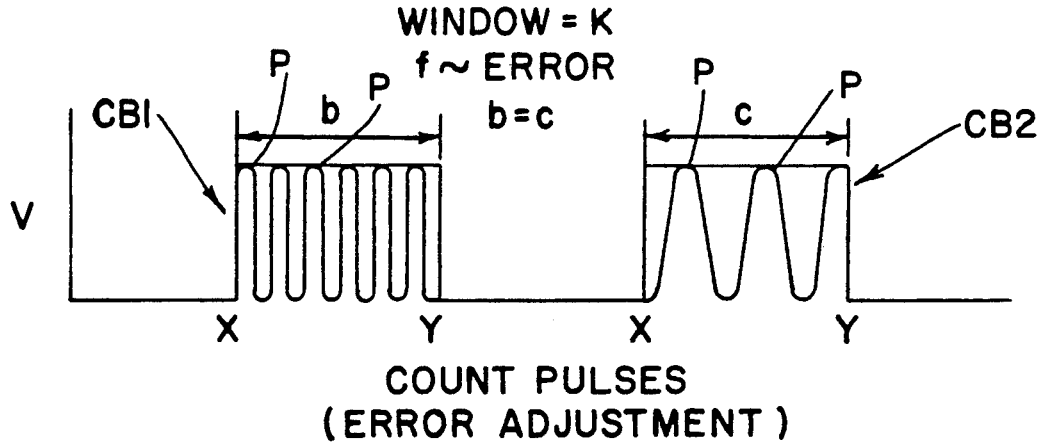
FIGS. 5 and 6 are voltage graphs showing counting bursts used in the preferred embodiment of the present invention with adjustment of either the output frequency component or the duration component of the counting bursts.
Figure 6:
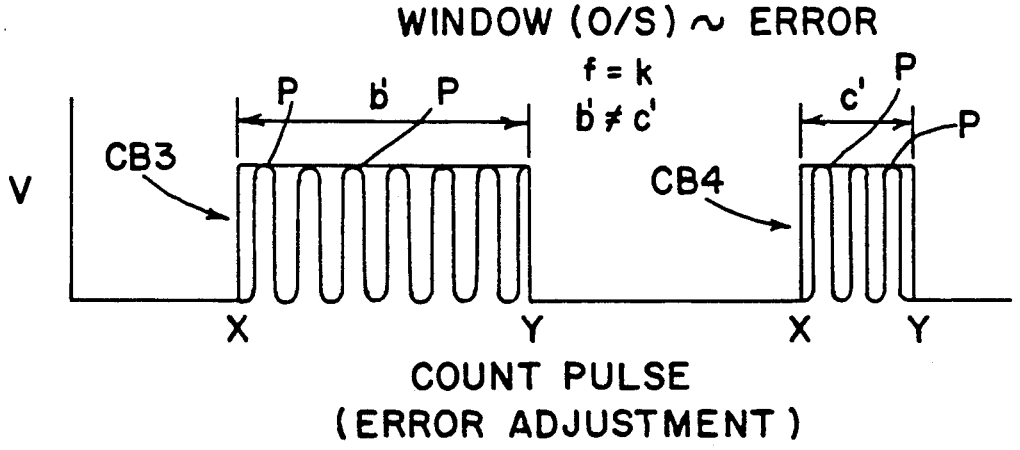

The first preferred embodiment of the present invention is illustrated in FIG. 3 and is used for converting the error signal in line 106 from error amplifier 100/102 into an appropriate reference value in line 122. In accordance with this first preferred embodiment of the invention, the basic control means or device is an AND gate 200 having an output 202 on which there is created a series of spaced output signals in the form of counting bursts, each of which includes a number of counting pulses P which number of pulses P is indicative of the detected error controlling the voltage on line 106. Such counting bursts are shown in FIGS. 5 and 6. The number of pulses P in each burst is determined by the frequency component of the counting bursts (the rate of pulses P) together with the duration component of the individual counting bursts (the time of the bursts).

Control device 200 gates counting bursts onto line 202 based upon the frequency component on input 204 and the enabling window or duration component on input 206. Referring initially to the frequency component on input 204 of the basic control means or device, i.e. AND gate 200, the frequency of the signal on this input line is determined by the output of voltage controlled oscillator 210 having a pulse rate control network 212 that adjusts the straight line frequency relationship between the voltage level on input 214 and the frequency output on line 204. The input voltage of oscillator 210 on line 214 is the error voltage on line 106. The output function of oscillator 210 is illustrated in FIG. 4. As the input voltage on line 214 increases, the frequency increases in a straight line function. The slope is controlled by network 212. A negative voltage on line 106 and, thus, line 214 causes a like increase in the output frequency. The polarity of the voltage on line 106 indicates the direction of the detected error. The magnitude of the voltage on line 106 indicates the amount of deviation of strip edge 14 from the desired position indicated by the adjusted value of set point 104. As the sensed error in line 106 increases, the frequency increases; therefore a greater number of counting pulses P are created during each counting burst. As schematically illustrated in the graph of FIG. 4A the periodic steps m, n, o etc. change the voltage on line 122. As the error is increased, the steps are greater in voltage. In the embodiments so far illustrated, the duration of each counting burst is determined by the length of time a signal remains on input line 206. Pulses P are created in a counting burst on line 202 at a rate determined by the amount of error. These bursts cause a stepped output in line 122, as indicated in the graph of FIG. 4A.

The time a logic 1 remains on line 206 determines the time or duration component of the counting bursts on output 202. Line 206 is shifted between an enabling logic 1 and a disabling logic 0 by one shot device 220 having an input 222 and an output illustrated as pulses **220*a* in line 206. The spacing a between pulses 220*a* is determined by the rate of the enabling signals on line 222, which line is the output of one shot actuator 230. This actuator performs the function of the schematically illustrated switch 110 in FIG. 2. Actuator 230 counts the input pulses from pulse generator 52 as they appear on line 232. When the accumulated number of input pulses on line 232 reaches a preselected value, a trigger signal occurs in line 222. This signal initiates a pulse 220*a* at the output of one shot device 220. An appropriate set of thumbwheels is provided on actuator 230 for adjusting the count value between trigger signals directed to line 222. This count value is correlated with the spacing between control point II and the location I. Thus, the spacing a is the time necessary for a preselected length of strip 10 to pass a point in the path. The measurement of strip length can be made at various locations by appropriate positioning of pulse generator 52. The initial adjustment of actuator 230 is a function of the distance between the pulse point II and the actuator point I. There is a greater spacing a when the spacing of the remotely located edge detector 60** is increased.

The counting bursts CB created on line 202 are directed to a cascaded up/down counter 240 having a digital to analog output stage schematically represented by potentiometer 242. Thus, the accumulated count of digital counter 240 is an analog voltage appearing at output 244. To determine the direction of counting for counter 240, there is provided a polarity detector 246 to provide a given binary logic on output line 248 representing the polarity of the error signal in line 106. The voltage on line 244 is directed through a double pole switch 250 to an output attenuator 252 which is connected to the input of a buffer amplifier 254 having an output connected to line 122.

The operation of the first preferred embodiment illustrated in FIG. 3 is apparent from the detailed description of the individual components. As shown in FIG. 5, a counting burst CBI has a duration b that is the time between the leading edge X and the trailing edge Y. The duration is referred to as the duration component of the burst. A number of individual counting pulses P determines the number of counting steps caused by the counting burst CB1 as it is received by counter 240. The duration component b of burst CBI is determined by the width of the pulse **220*a* on input line 206 from one shot device 220. The number of pulses P during this duration component is determined by the frequency component of the signal on line 204. This frequency is controlled by the output of voltage controlled oscillator 210. During normal operation, the speed of strip 10 remains constant. Thus, the duration of successive bursts, represented by duration b and duration c of bursts CB1, CB2 of FIG. 5, is constant. As the value of the instantaneous error increases, the number of pulses P during the counting burst increases because of a frequency increase in line 204. Counting burst CB1 has a large number of pulses P and is indicative of a substantial instantaneous error. As this error decreases, a counting burst has a fewer number of counting pulses P due to a lower frequency. This is illustrated as counting burst CB2. The duration c remains the same as duration b, since one shot device has a fixed output pulse. Thus, during a counting burst with a lower error, a reduced number of pulses P are directed by line 204 to counter 240**.

Referring now to FIG. 6, an example is illustrated wherein the error controls bursts CB3, CB4 by changing the duration of the bursts while using a fixed frequency on line 204 by any conventional fixed frequency oscillator. The error of moving strip 10 decreases substantially from burst CB3 to burst CB4. Thus, the duration b' of counting burst CB3 is greater than duration c' of counting bursts CB4. The frequency remains the same in this example which involves changing the length of pulses 220*a* in response to the error. A reduction in the distance between the leading edge X and trailing edge Y of the pulse in line 206 caused by a reduced error reduces the number of count pulses P in counting burst CB4. By using the concept of digital counting bursts with a digital counter, the number of count pulses P per sample of the error can be controlled accurately and modified in a controlled manner to provide accuracy and stability.

Figure 8:
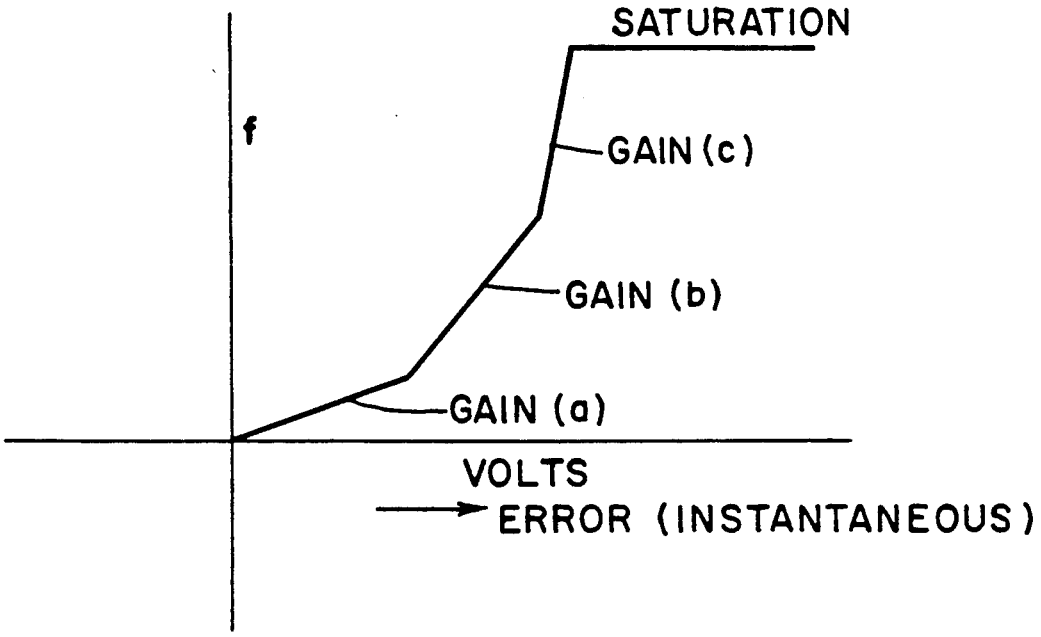
FIG. 8 is a function curve for a voltage controlled oscillator having characteristics employed in the second preferred embodiment of the present invention illustrated in FIG. 7 and illustrated in more detail in FIG. 11.
Figure 7:
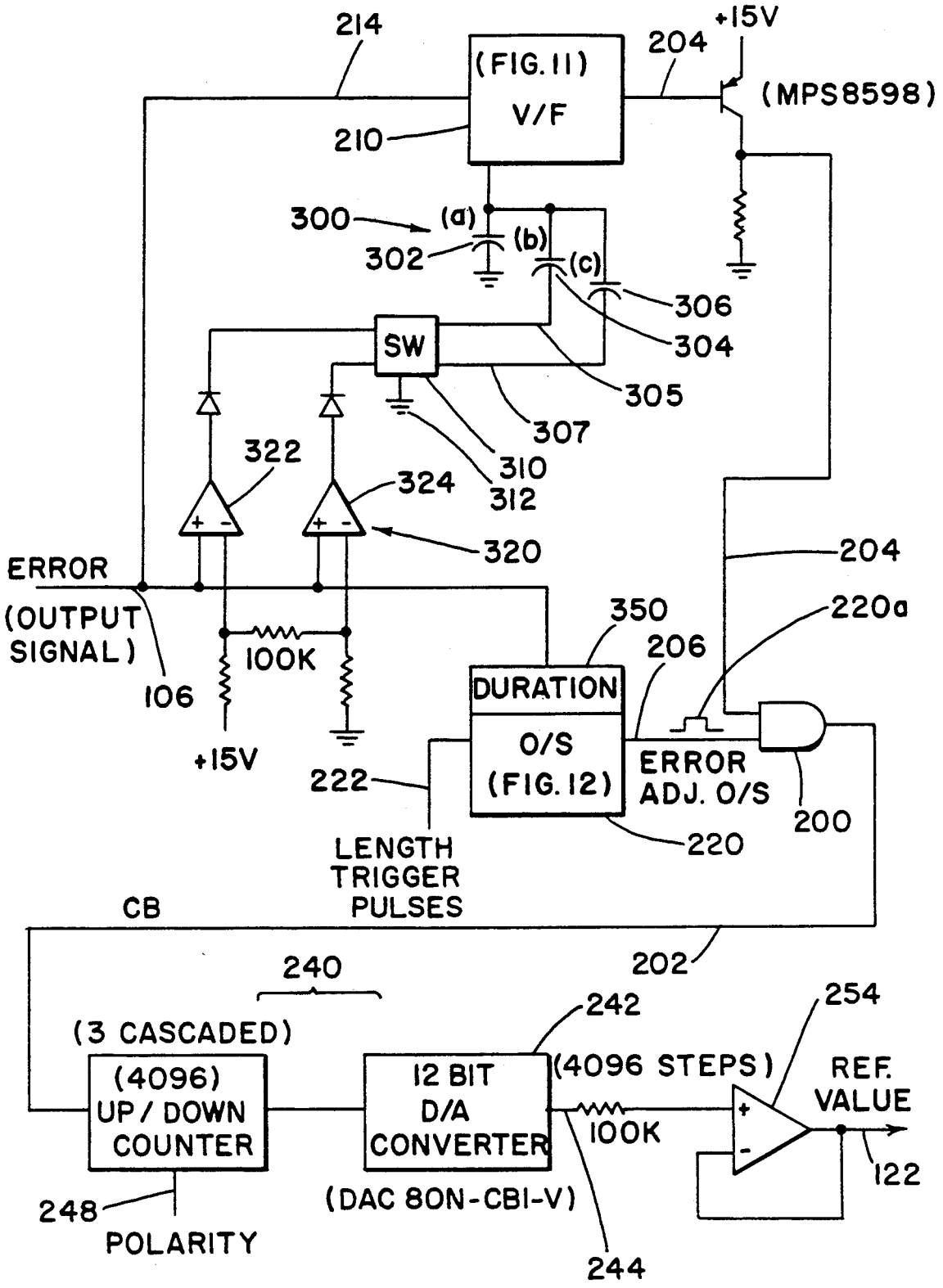
FIG. 7 is a schematic wiring diagram showing a second preferred embodiment of the present invention wherein the voltage controlled oscillator has a function curve as illustrated in FIG. 8.
Figure 9:
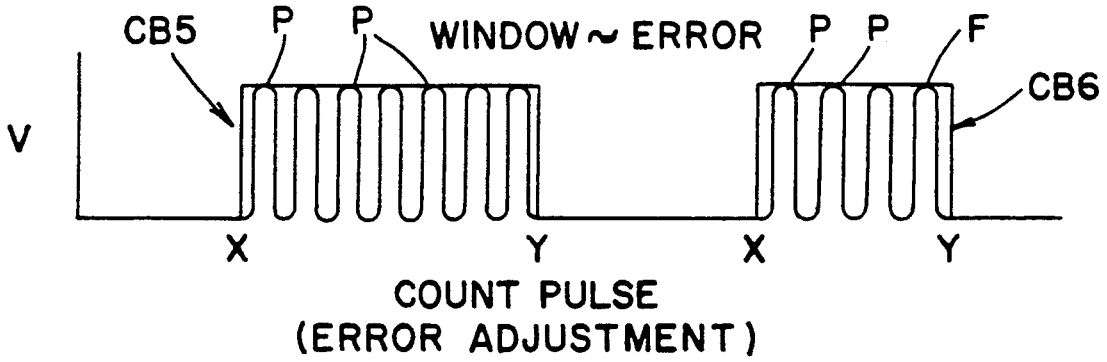
FIG. 9 is a voltage curve showing counting bursts used in the present invention and illustrating an adjustable duration as a function of error as employed in the second preferred embodiment of FIG. 7 and in combination with a variable frequency component.
Figure 10:
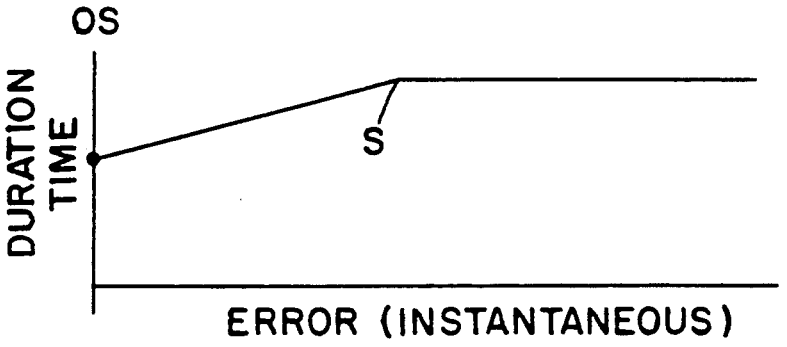
FIG. 10 is an output characteristic of the one shot device where the duration of the counting bursts is a function of error as employed in the second preferred embodiment shown in FIG. 7 and illustrated in more detail in FIG. 12.
Figure 11:
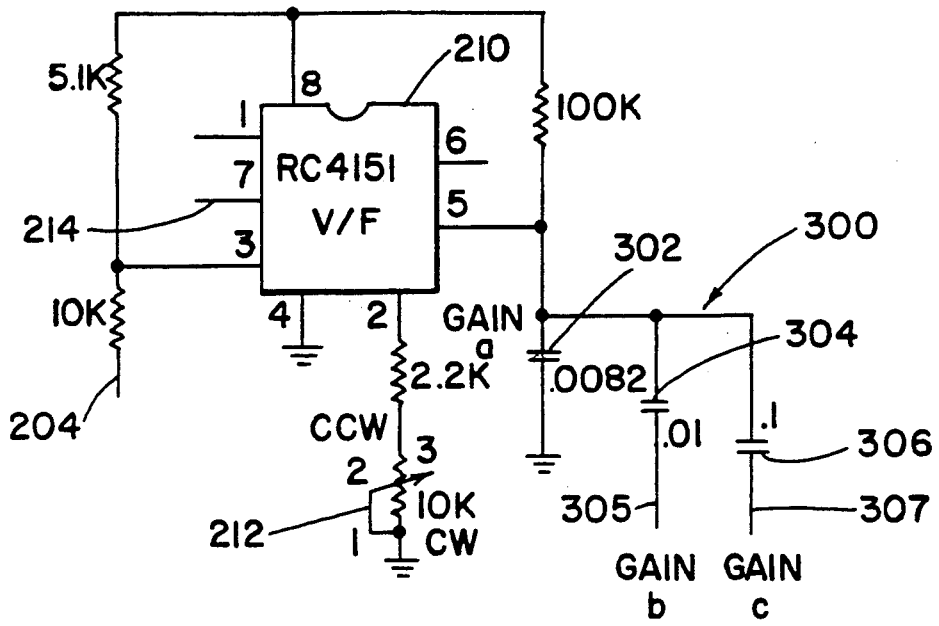
FIG. 11 is a detailed wiring diagram of the voltage controlled oscillator employed in the preferred embodiment shown in FIG. 7; and, FIG. 12 is a detailed wiring diagram of the error controlled one shot device employed in the second preferred embodiment of the present invention shown in FIG. 7.

Referring now to FIGS. 7–12, a second preferred embodiment of the invention is illustrated wherein like reference numbers on elements indicate correspondence to the same components or elements in FIG. 3. The primary control device or control means 200 is the previously discussed AND gate having an output line 202 for receiving counting bursts CB each time a given length of strip is sensed by the output of pulse generator 52, shown in FIG. 1. The frequency component of counting burst CB is directed to gate 200 on line 204, while the duration component for the counting burst is directed to the gate on line 206. In the second preferred embodiment of the invention, the voltage controlled oscillator 210, which is shown in more detail in FIG. 11, is provided with a gain selector network 300 wherein the normal gain (a) is controlled by capacitor 302 and has the slope shown in FIG. 4. Capacitor 304 is grounded by line 305 to cause a second gain (b) greater than gain (a). In a like manner, still a greater gain (c) is created at oscillator 210 by capacitor 306 through control of the logic on line 307. A digital switch 310 connects line 305 or line 307 to ground 312 by a comparator network 320, having a first voltage threshold detector 322 and a second, higher, voltage threshold detector 324. As the voltage level on line 106 increases, detector 322 actutates switch 310 to ground line 305. Oscillator 210 then operates with second gain (b). As the error increases further, the voltage on line 106 causes capacitor 306 to be grounded for shifting oscillator 210 to a third gain (c) by operation of switch 310. The variable output function for oscillator 210, as shown in FIGS. 7 and 11, is illustrated in FIG. 8. As the error increases, the slope of the output function increases to cause a higher corrective frequency in line 204. In this manner, a more rapid correction of the strip position occurs as greater deviation of strip edge 14 from the desired position is sensed. Of course, negative errors have the same gain characteristics as shown in FIG. 8 but in a different quadrant.

Figure 12:
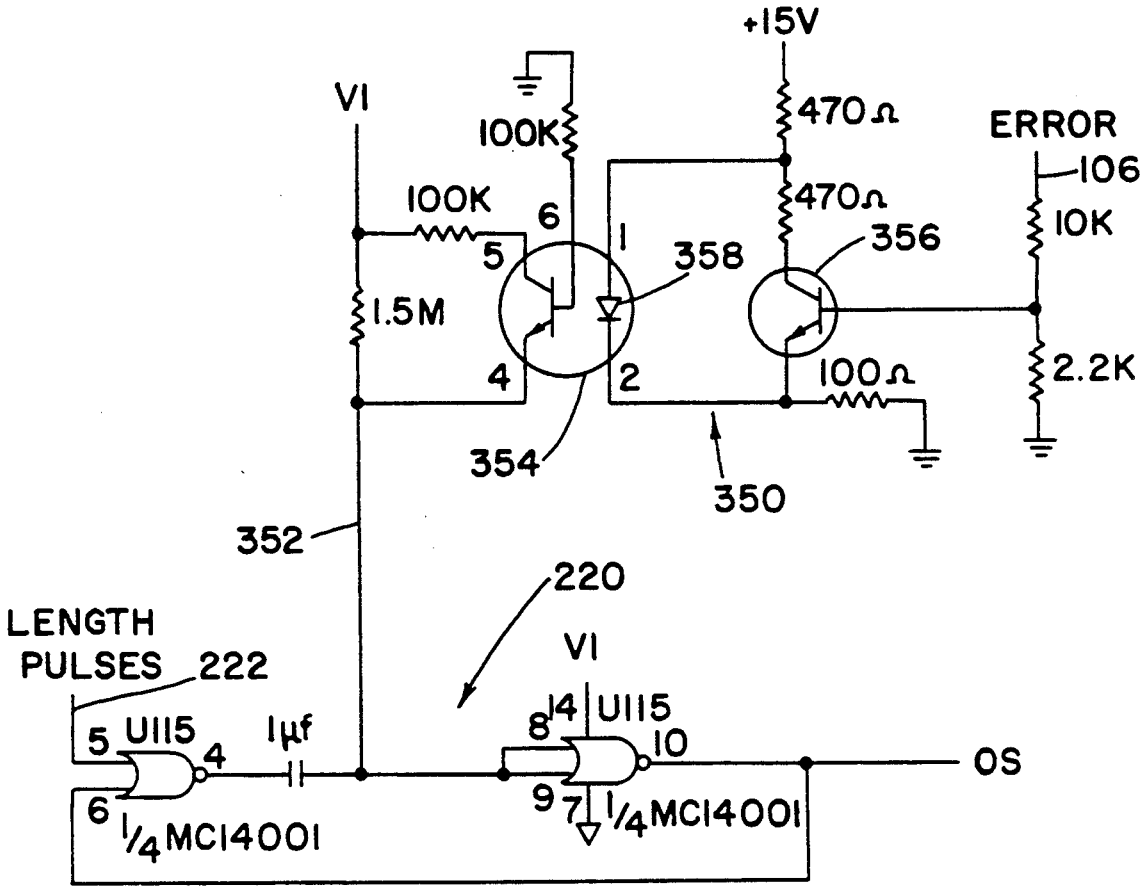

To control the duration component of the output burst CB on line 202, the second preferred embodiment of the invention includes a duration control circuit 350, best shown in FIG. 12. As the error increases, the voltage on line 106 increases to increase the duration of pulses 220*a*. As shown in FIG. 12, an optical coupling 354 is controlled by transistor 356 which changes the current flow through diode 358. As the error increases, the voltage on line 106 increases and a similar voltage increase is realized in one shot control line 352. This increase of voltage on line 352 increases the length of the duration component between the leading edge X and the trailing edge Y of the counting pulses CB, which edges define the duration component of the bursts. This function is illustrated in FIGS. 9 and 10, wherein the counting burst CB5 is greater in duration than the counting burst CB6. The difference in the duration component of burst CB5, CB6 is caused by a difference in the voltage on line 106 during these two bursts. FIG. 10 illustrates the pulse width control function. An increase in the duration time is a straight line function of an increased error voltage. Saturation occurs at point S; however, the operating range is generally below the saturation point of the optical coupling 354. The counting bursts CB5, CB6 are shown with the same frequency component. The number of pulses P is a direct function of the difference in duration caused by a difference in voltage on line 106. This representation indicates that the duration circuit 350 could be added to the control circuit shown in FIG. 3 with a fixed oscillator instead of a voltage controlled oscillator. In a like manner, merely the modified voltage controlled oscillator shown in FIG. 11 could be employed in the system illustrated in FIG. 3. In the preferred embodiment, however, both the modified oscillator 210 and the duration control circuit 350 is used so that there is a cascading effect on the corrective action of the primary loop as the error increases.

The embodiment shown in FIG. 3 has been explained with selector switches 270*a*, 270*b* being in the 'AUTO' position, which is the operating position of the guiding system. At times, it is necessary to change the position of actuator 132 for a different set-up. This is accomplished by shifting switches 270*a*, 270*b* to the "SET-UP" position so a manually selected voltage signal can be applied to line 106 from a set-up input 360 through buffer 362 having an output 364. Line 370 bypasses gate 200 to apply a rapid, constant series of pulses to counter 240. This adjusts the position of the payout reel while the primary loop is active. Switches 270*a*, 270*b* can be shifted to the "CENTERING" position to drive line 244 to zero.

Having thus defined the invention, the following is claimed:

1. An apparatus for guiding a strip traveling along a selected path, said apparatus comprising: a strip position correcting means engaged with said strip at a first location for changing the position of said strip as it moves from said first position, said strip correcting means including an actuator for moving said strip position and a feedback control device with a signal indicative of the actual position of said strip adjacent said actuator and an adjustable reference value whereby said feedback control device adjusts said actual position indicating signal toward said reference value; an edge sensor at a control point on said strip path remote to said first position generating an output error signal generally proportional to the deviation of the edge strip from a selected position at said control point; control means for periodically changing said reference value in accordance with said output error signal, said control means including means for creating a series of counting bursts having a number of count pulses of a given frequency component and with a selected duration component, means for changing at least one of said component of said control bursts in accordance with the magnitude of said output error signal wherein at least one of said components is the frequency component having a means for causing said frequency component to vary as a non-linear function of the magnitude of said output error signal, and at least one of said components also includes the duration component; and counter means for accumulating said series of counting pulses to control the magnitude of said reference value.

2. An apparatus for guiding a strip traveling along a selected path, said apparatus comprising: a strip position correcting means engaged with said strip at a first location for changing the position of said strip as it moves from said first position, said strip correcting means including an actuator for moving said strip position and a feedback control device with a signal indicative of the actual position of said strip adjacent said actuator and an adjustable reference value whereby said feedback control device adjusts said actual position indicating signal toward said reference value; an edge sensor at a control point on said strip path remote to said first position generating an output error signal generally proportional to the deviation of the edge strip from a selected position at said control point; control means for periodically changing said reference value in accordance with said output error signal, said control means including means for creating a series of counting bursts having a number of count pulses of a given frequency component and with a selected duration component, means for changing at least one of said component of said control bursts in accordance with the magnitude of said output error signal wherein at least one of said components is the frequency component; and at least one of said components also includes the duration component; and counter means for accumulating said series of counting pulses to control the magnitude of said reference value.

3. An apparatus for guiding a strip traveling along a selected path, said apparatus comprising: a strip position correcting means engaged with said strip at a first location for changing the position of said strip as it moves from said first position, said strip correcting means including an actuator for moving said strip position and a feedback control device with a signal indicative of the actual position of said strip adjacent said actuator and an adjustable reference value whereby said feedback control device adjusts said actual position indicating signal toward said reference value; an edge sensor at a control point on said strip path remote to said first position generating an output error signal generally proportional to the deviation of the edge strip from a selected position at said control point; control means for periodically changing said reference value in accordance with said output error signal, said control means including means for creating a series of counting bursts having a number of count pulses of a given frequency component and with a selected duration component, said control means includes a voltage controlled oscillator to create said frequency component with the output error signal being a voltage input to said oscillator and having a voltage proportional to the deviation of said strip edge at said control point whereby said frequency of said oscillator varies proportionally with said voltage input; means for changing at least one of said components of said counting bursts in accordance with the magnitude of said output error signal wherein said at least one of said components is the frequency component and at least one of said components also includes the duration component; and counter means for accumulating said series of counting pulse to control the magnitude of said reference value.

4. An apparatus for guiding a strip traveling along a selected path, said apparatus comprising: a strip position correcting means engaged with said strip at a first location for changing the position of said strip as it moves from said first position, said strip correcting means including an actuator for moving said strip position and a feedback control device with a signal indicative of the actual position of said strip adjacent said actuator and an adjustable reference value whereby said feedback control device adjusts said actual position indicating signal toward said reference value; an edge sensor at a control point on said strip path remote to said first position generating an output error signal generally proportional to the deviation of the edge strip from a selected position at said control point; control means for periodically changing said reference value in accordance with said output error signal, said control means including means for creating a series of counting bursts having a number of count pulses of a given frequency component and with a selected duration component, said control means includes length measuring means for creating one of said counting bursts each time a preselected length of strip passes said control point, means for changing at least one of said components of said output counting bursts in accordance with the magnitude of said output error signal wherein at least one of said components is the frequency component, means for causing said frequency component to vary as a non-linear function of the magnitude of said output error signal, and at least one of said components also includes the duration component; and counter means for accumulating said series of counting pulses to control the magnitude of said reference value.

5. An apparatus for guiding a strip traveling along a selected path, said apparatus comprising: a strip position correcting means engaged with said strip at a first location for changing the position of said strip as it moves from said first position, said strip correcting means including an actuator for moving said strip position and a feedback control device with a signal indicative of the actual position of said strip adjacent said actuator and an adjustable reference value whereby said feedback control device adjusts said actual position indicating signal toward said reference value; an edge sensor at a control point on said strip path remote to said first position generating an output error signal generally proportional to the deviation of the edge strip from a selected position at said control point; control means for periodically changing said reference value in accordance with said output error signal, said control means including means for creating a series of counting bursts having a number of count pulses of a given frequency component and with a selected duration component, said control means includes length measuring means for creating one of said counting bursts each time a preselected length of strip passes said control point and a means for changing said preselected length; means for changing at least one of said components of said counting bursts in accordance with the magnitude of said output error signal wherein at least one of said components is the frequency component, means for causing said frequency component to vary as a non-linear function of the magnitude of said output error signal, and at least one of said components also includes the duration component; and counter means for accumulating said series of counting pulses to control the magnitude of said reference value.

6. In a device for controlling the position of a moving strip including a primary control loop having an actuator to adjust said position, a means for creating signal indicative of the actual position of said actuator, means for creating a reference signal indicative of the desired position of said actuator, means for comparing said actual position signal with said reference signal to give an error signal and means for adjusting said actuator to reduce said error signal and a sensing system remote to said actuator including a sensor to detect the edge of said moving strip at a control point, means for creating an output error voltage signal indicative of said deviation of said edge for a selected position, means for creating a reference value as a direct function of said output voltage signal, means for adjusting said reference signal by said reference value, the improvement comprising: said reference value creating means comprising a digital counter with an accumulated count for controlling said reference value, means for creating a counting burst having a number of count pulses indicative of the magnitude of said output error signal when a given length of strip passes said control point, said counting burst creating means includes means for adding the output of a voltage controlled oscillator with the output pulse of the pulse generator, said output pulses having a preselected duration and being created when said given length passes said control points, means for changing said duration in accordance with said output voltage, and means for directing said counting bursts to said digital counter.

* * * * *